US011873069B2

(12) United States Patent
Cox

(10) Patent No.: US 11,873,069 B2
(45) Date of Patent: Jan. 16, 2024

(54) SWIM AID DEVICE AND METHOD OF USE THEREOF

(71) Applicant: Andrew Cox, Long Beach, CA (US)

(72) Inventor: Andrew Cox, Long Beach, CA (US)

( * ) Notice: Subject to any disclaimer, the term of this patent is extended or adjusted under 35 U.S.C. 154(b) by 0 days.

(21) Appl. No.: 17/249,467

(22) Filed: Mar. 2, 2021

(65) Prior Publication Data

US 2021/0269130 A1 Sep. 2, 2021

Related U.S. Application Data

(60) Provisional application No. 62/983,944, filed on Mar. 2, 2020.

(51) Int. Cl.
*B63C 9/135* (2006.01)
*A63B 31/00* (2006.01)

(52) U.S. Cl.
CPC ..... *B63C 9/135* (2013.01); *A63B 31/00* (2013.01)

(58) Field of Classification Search
CPC ..... B63C 9/13; B63C 2009/131; B63C 2009/133; B63C 9/135; B63C 9/15; B63C 9/155; A63B 31/00; A41D 13/0125
See application file for complete search history.

(56) References Cited

U.S. PATENT DOCUMENTS 1,544,672 A * 7/1925 Milbury ..... B63C 9/155 441/123
1,831,472 A * 11/1931 Abramowitz ..... B63C 9/135 441/113
2011/0263387 A1* 10/2011 Sporn ..... A63B 69/14 482/55
2021/0260460 A1* 8/2021 Wigo ..... A63B 31/00

* cited by examiner

*Primary Examiner* — Andrew Polay
(74) *Attorney, Agent, or Firm* — Innovent Law P.C.; Karima Gulick

(57) ABSTRACT

A swim aid device comprising a belt having a hoop portion including a first tab and a second tab, a front end and a back end opposite said front end wherein the back end includes an opening and wherein the belt is biased in a first closed position and operatively openable to a second open position; and one or more buoyant elements couplable to said back end of the belt and securable in place with said tabs wherein a buoyancy of the one or more buoyant elements allows a user to remain afloat.

18 Claims, 15 Drawing Sheets

SWIM AID DEVICE AND METHOD OF USE THEREOF

The current application claims the benefit of Provisional Patent Application No. 62/983,944 filed Mar. 2, 2020.

BACKGROUND OF THE INVENTION

1. Field of the Invention

This invention relates generally to swimming aids. More particularly, the invention relates to a device useful in swimming and a swim aid device for supplementing the buoyancy of a swimmer while allowing free leg and arm movements.

2. Description of the Related Art

In markets today, there are very limited products offered for swimming aids and devices to help novice swimmer control buoyancy while learning to move about in water and learning to swim. In trying to teach beginner swimmers these skills, single devices or various devices can be used in conjunction. A common problem with these devices is the fact that they restrict either upper body movement or lower body movement. In addition, there are no solutions on the market today that aid a swimmer while helping him or her to remain buoyant on their own.

Other solutions on the market can be bulky or sometimes come off a person's body easily while in the water. Several types of swimming aides exist to aid swim students in learning to swim. Some of these devices include flat flutter boards, which are typically composed of a foam and buoy the student during kicking-type exercises. Flutter boards may be difficult to grasp while practicing kicking strokes and uncomfortable to rest on. Other devices such as arm buoys do not help swimmers staying afloat at an angle which would allow them to swim and move about a body of water freely. Other flotation devices, for example, pool noodles, do not hold a solid form, are unwieldy when practicing many types of strokes, and are not comfortable when supporting the swimmer's body.

Currently, there are no useful alternatives that effectively assist a beginner swimmer in learning to swim properly. As will be disclosed below, the present disclosure addresses these needs and covers a device and method which allows a person to remain afloat at a desired swimming angle while allowing for free arm and leg movement to prevent these inconveniences and solve these issues.

SUMMARY OF THE INVENTION

In one aspect, the present invention is embodied as a swim aid device which helps a person float at a desired angle. The device includes a belt to be worn around a person's body and the belt is coupled to two floats. The floats are hollow for buoyancy. The present disclosure allows for arm movement and side to side movement of a person and does not restrict neither arm movement nor leg movement.

In one embodiment, the present disclosure is a swim aid device comprising a belt having a first end and a second end terminating in tabs and one or more hollow floats securely coupled to the belt such that when a user is immersed, the one or more floats remain coupled to said belt. In some embodiments, the belt terminates in clips which are adapted to be coupled to the floats and ensure that the floats remain securely attached to the belt even if a user jumps into the water or moves about a lot. The belt can be rigid or soft and can include a protruding front end for added buoyancy and for ease of use. In some embodiments, the floats include clip attachments adapted to engage with the belt clips and further ensure that the floats remain securely attached to the device at all times.

In some embodiments, the one or more floats include a protruding element at the bottom end of the float to help a swimmer remain at a desired angle when in the water, and to ensure that a user's head does not get submerged when swimming. These protruding elements also help keep a user afloat with the forward portion of their body above water.

In accordance with one form of this disclosure, there is provided a method for using a swim aid device where a user wears said device around a person's body. The belt comprises opening between two floats and a user can stretch the belt to wear it around the waist. The rigid belt allows for the device to be worn around the body without a need for a closure mechanism. The floats are worn around the back of a user.

The present disclosure is embodied in a swim aid product for children to use in a pool, aquatic environment or other bodies of water. The present device aids in the flotation of a child, leaving the arms and legs free to move around in the water. The present device is a toy and is not a "flotation device" or "life-saving" device and should only be used under proper parental supervision.

In one embodiment, the present disclosure is a swim aid device comprising a belt having a hoop portion including a first tab and a second tab, a front end and a back end opposite said front end wherein the back end includes an opening and wherein the belt is biased in a first closed position and operatively openable to a second open position. The swim aid device also includes one or more buoyant elements couplable to said back end of the belt and securable in place with said tabs wherein a buoyancy of the one or more buoyant elements allows a user to remain afloat.

In some embodiments, the belt of the swim aid device is rigid and elastically deformable to said second open position to extend about a waist of the user. In other embodiments, the belt is elastically deformed from the first closed position to said second open position to extend about the waist of the user, said belt goes back to the biased first closed position and remains secure around the waist of the user.

In an alternative embodiment the belt of the swim aid of the present disclosure generally conforms to a waist of the user and wherein a user's arms, torso and legs are uncovered and unrestricted such that the swim aid device provides flotation assistance and avoids interference with a swimming activity. In other embodiments, hoop portion terminates in a first tab opposing the second tab and the first tab and said second tab extend at an angle and away from said hoop portion such that the one or more buoyant elements are securable to the belt. In yet another embodiment, the tabs further terminate in a stop portion such that the one or more buoyant elements are securable to the belt. Sometimes, the tabs further comprise a notch such that said one or more buoyant elements are securable to the belt.

In some embodiments, the tabs further comprise a clip, a hook and loop, a latch and lock, a releasable buckle, and/or a clasp such that the one or more buoyant elements are couplable to said belt. While in other embodiments, the front end of the belt comprises a hollowed-out protrusion adapted to keep the user in a swimming position and with a head of the user away from a body of water.

In one embodiment the one or more buoyant elements are substantially cylindrical and further include a handle couplable to said tabs. In other embodiments, the one or more buoyant elements are hydrodynamically shaped and placeable about a back of the user such that the swim aid device allows for swimming training and allows a user to remain in a swimming position.

In some embodiments, the one or more buoyant elements further comprise an indentation allowing a clearance of the tabs and securing said one or more buoyant elements to the belt. In other embodiments, the one or more buoyant elements further comprise a top end and a bottom end opposite the top end and a main body and where the top end is dome shaped and efficiently hydrodynamic. In yet another embodiment, the bottom end of the buoyant elements extend outwardly from a radius of the main body further allowing a user to remain in a swimming position. And in another embodiment, the bottom end of the buoyant element is substantially flat.

In another embodiment, the swim aid device of the present disclosure has a belt having a front end and a back end opposite the front end where the back end comprises a closure mechanism and where the front end comprises a floating element. The swim aid device also includes one or more buoyant elements couplable to the back end of the belt where the swim aid device allows a user to remain in a swimming position and with a head of the user away from a body of water. In another embodiment, the one or more buoyant elements also include a channel operatively couplable to the belt and can be inserted into a belt and secured about the back end of the belt.

The present disclosure can also be embodied in a method of swimming training using a swim aid device comprising a belt having a hoop portion including a first tab and a second tab, a front end and an opposite back end where the back end comprises an opening and where the belt is biased in a first closed position and operatively openable to a second open position, one or more buoyant elements couplable to said back end of the belt and securable in place with said tabs wherein a buoyancy of the one or more buoyant elements allows a user to remain afloat. The method includes the steps of i) opening the belt of the swim aid device and securing said swim aid device around a waist of the user; ii) allowing said swim aid device to regain its biased first closed position; iii) positioning the back end of the swim aid device and the one or more buoyant elements along a back of the user; iv) entering a body of water with a head upward; v) initiating a swimming position wherein a torso of the user is in the body of water and the back of the user is afloat all while the head of the user remains outside of the body of water; and vi) performing a swimming training exercise.

In other embodiment the device also has a front buoyant element along the front end of the belt and the method also includes the step of placing the front buoyant element along a front of the waist of the user prior to the step of entering the body of water. In other embodiments of the method, the method includes the steps of tightening the swim aid device around the waist of the user.

Before explaining the various embodiments of the invention in detail, it is to be understood that the invention is not limited in its application to the details of construction and to the arrangements of the components set forth in the following description or illustrated in the drawings. Rather, the invention is capable of other embodiments and of being practiced and carried out in various ways. Also, it is to be understood that the terminology employed herein is for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

For a better understanding of the invention, its operating advantages and the specific objects attained by its uses, reference should be made to the accompanying drawings and descriptive matter in which there are illustrated preferred embodiments of the invention.

Various objects, features, aspects and advantages of the present embodiment will become more apparent from the following detailed description of embodiments of the embodiment, along with the accompanying drawings in which like numerals represent like components.

BRIEF DESCRIPTION OF THE DRAWINGS

It should be noted that the drawing figures may be in simplified form and might not be to precise scale.

The same elements or parts throughout the figures of the drawings are designated by the same reference characters, while equivalent elements bear a prime designation.

DETAILED DESCRIPTION OF THE INVENTION

Figure 1:
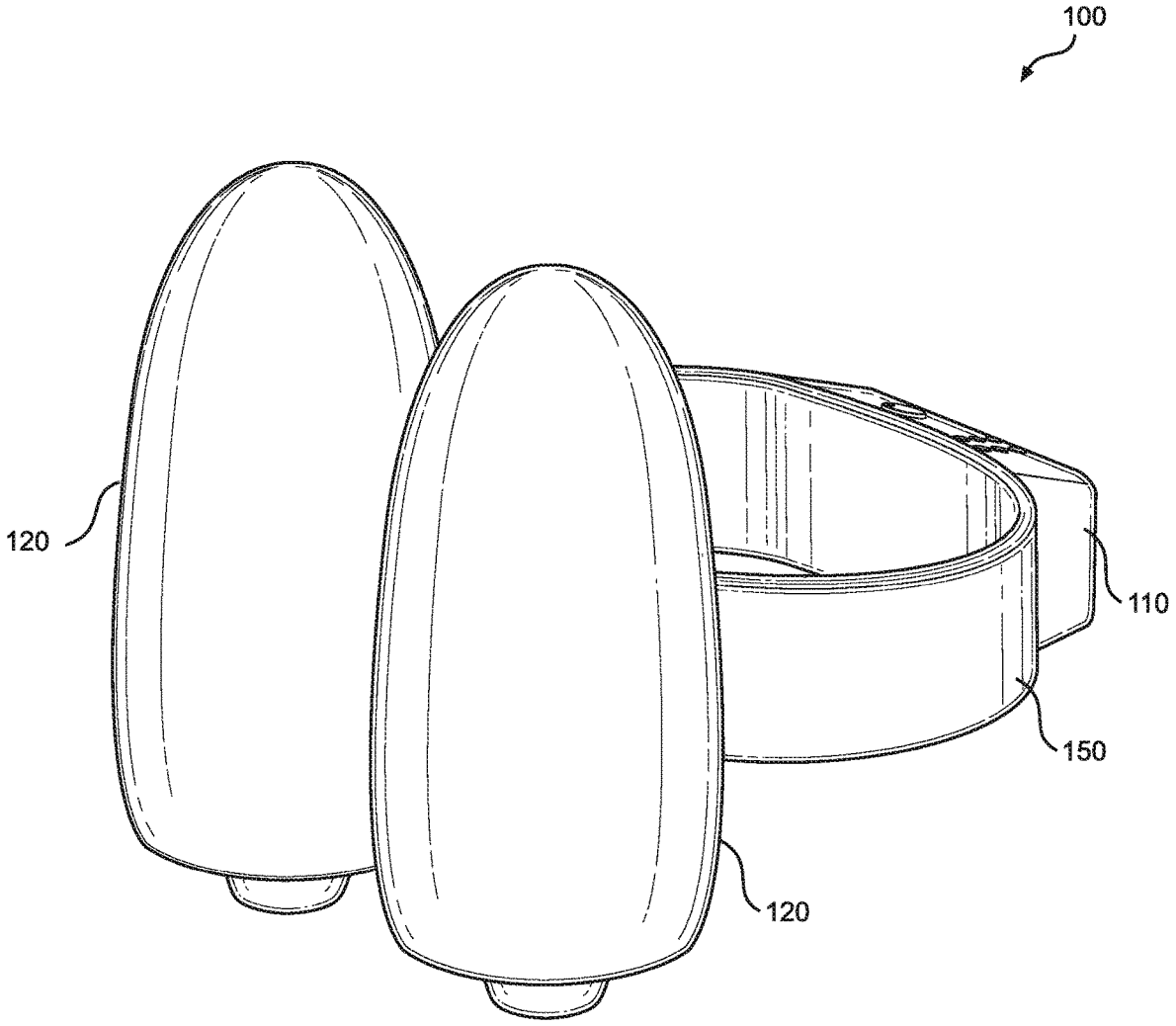
FIG. 1 is a front perspective view of one embodiment of the present disclosure showing the swim aid device.
Figure 2:
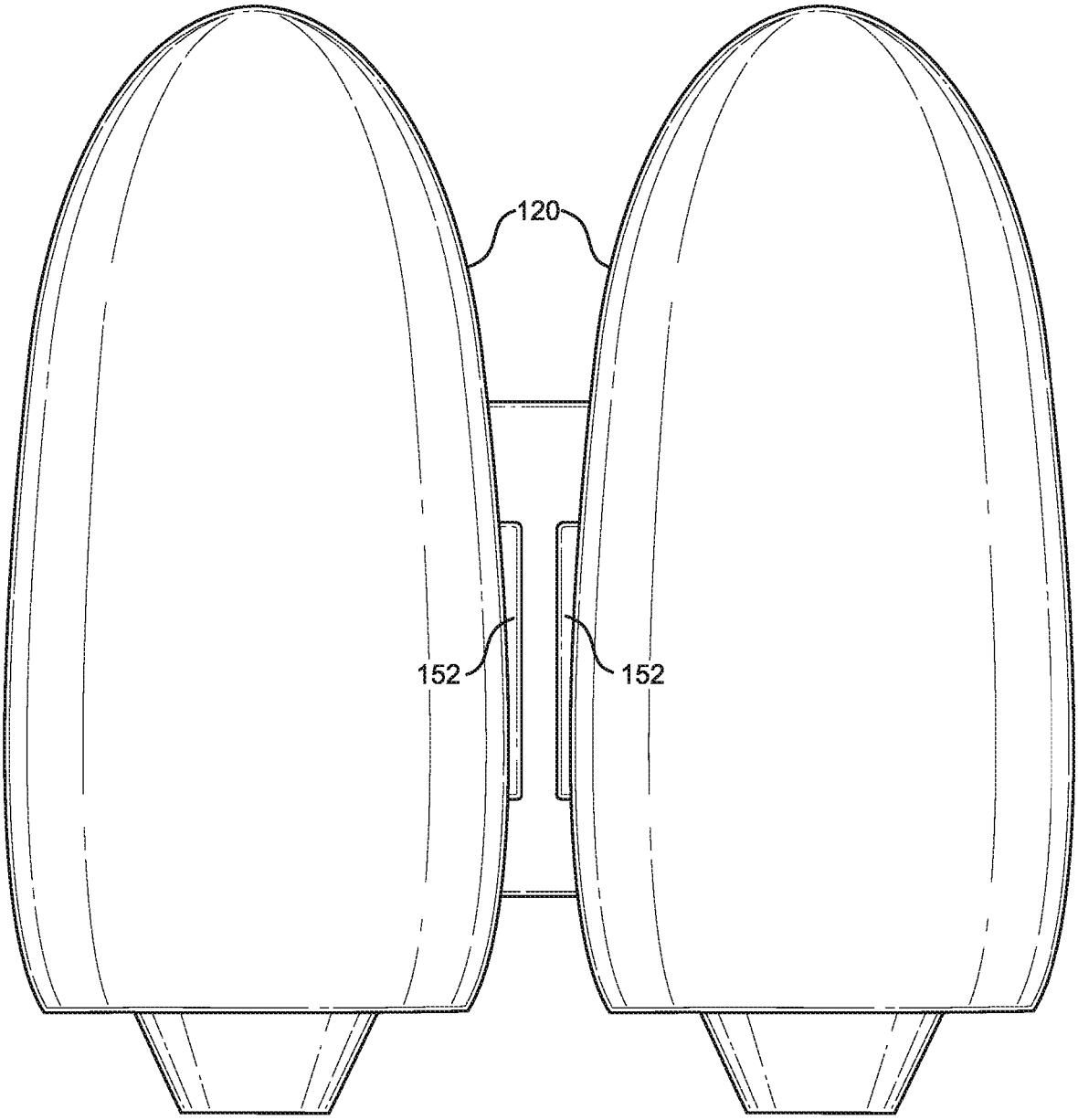
FIG. 2 is a rear view of one embodiment of the present disclosure.
Figure 3:
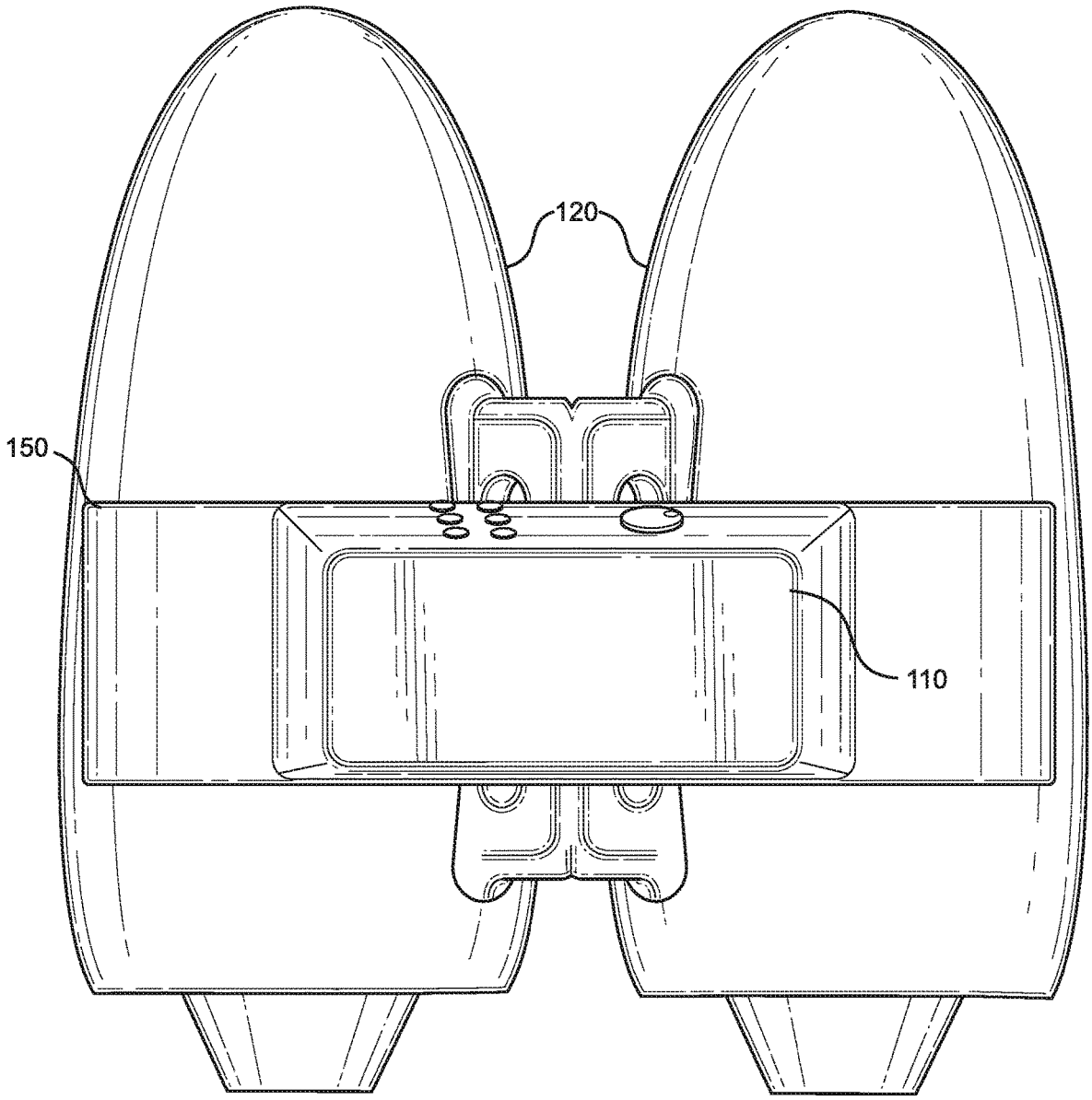
FIG. 3 is a front view of one embodiment of the present disclosure.
Figure 4:
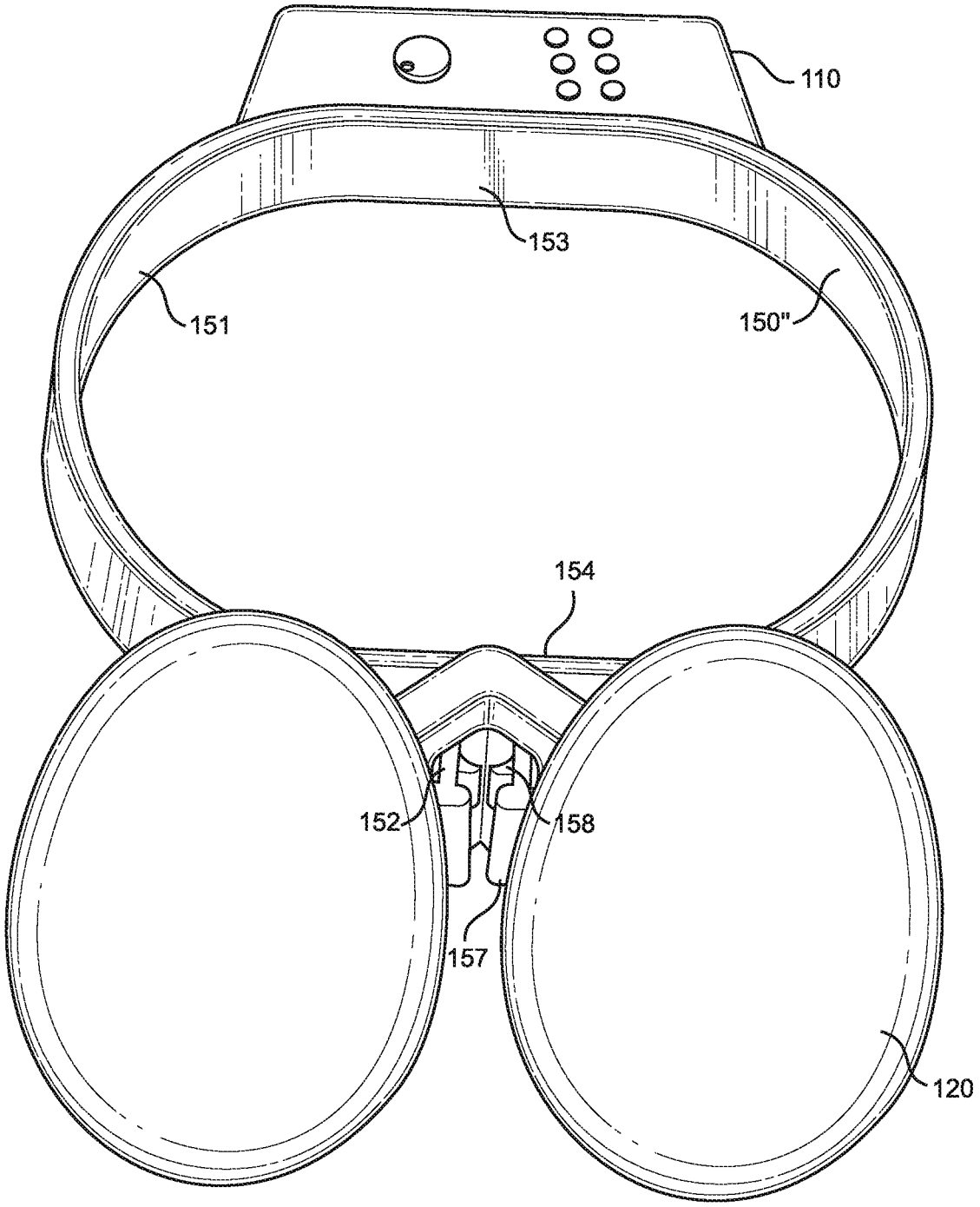
FIG. 4 is a top perspective view of another embodiment of the present disclosure.

The embodiment and various embodiments can now be better understood by turning to the following detailed description of the embodiments, which are presented as illustrated examples of the embodiment defined in the claims. It is expressly understood that the embodiment as defined by the claims may be broader than the illustrated embodiments described below. Many alterations and modifications may be made by those having ordinary skill in the art without departing from the spirit and scope of the embodiments.

Referring now to the drawings and the characters of reference marked thereon, FIGS. 1, 2, 3 and 4 show one embodiment of the swim aid device. Here, a swim aid device 100 comprises a belt 150 having a hoop portion 151 including a first tab 152*a* and a second tab 152*b*, a front end 153 and a back end 154 opposite said front end. The back end includes an opening 155 and the belt is biased in a first closed position and operatively openable to a second open position. The swim aid device also includes one or more buoyant elements 120 couplable to the back end 154 of the belt 150 and securable in place with the tabs 152. Here, a buoyancy of the one or more buoyant elements 120 allows a user to remain afloat.

In some embodiments, the belt 150 of the swim aid device is rigid and elastically deformable to said second open position to extend about a waist of the user. In other embodiments, the belt is elastically deformed from the first closed position to said second open position to extend about the waist of the user, said belt goes back to the biased first closed position and remains secure around the waist of the user.

In an alternative embodiment the belt of the swim aid of the present disclosure generally conforms to a waist of the user and wherein a user's arms, torso and legs are uncovered and unrestricted such that the swim aid device provides flotation assistance and avoids interference with a swimming activity. In other embodiments, hoop portion 151 terminates in a first tab 152*a* opposing the second tab 152*b* and the first tab and said second tab 152 extend at an angle and away from the hoop portion 151 such that the one or more buoyant elements 120 are securable to the belt and will not come off or slip away from the swim aid device.

Figure 5:
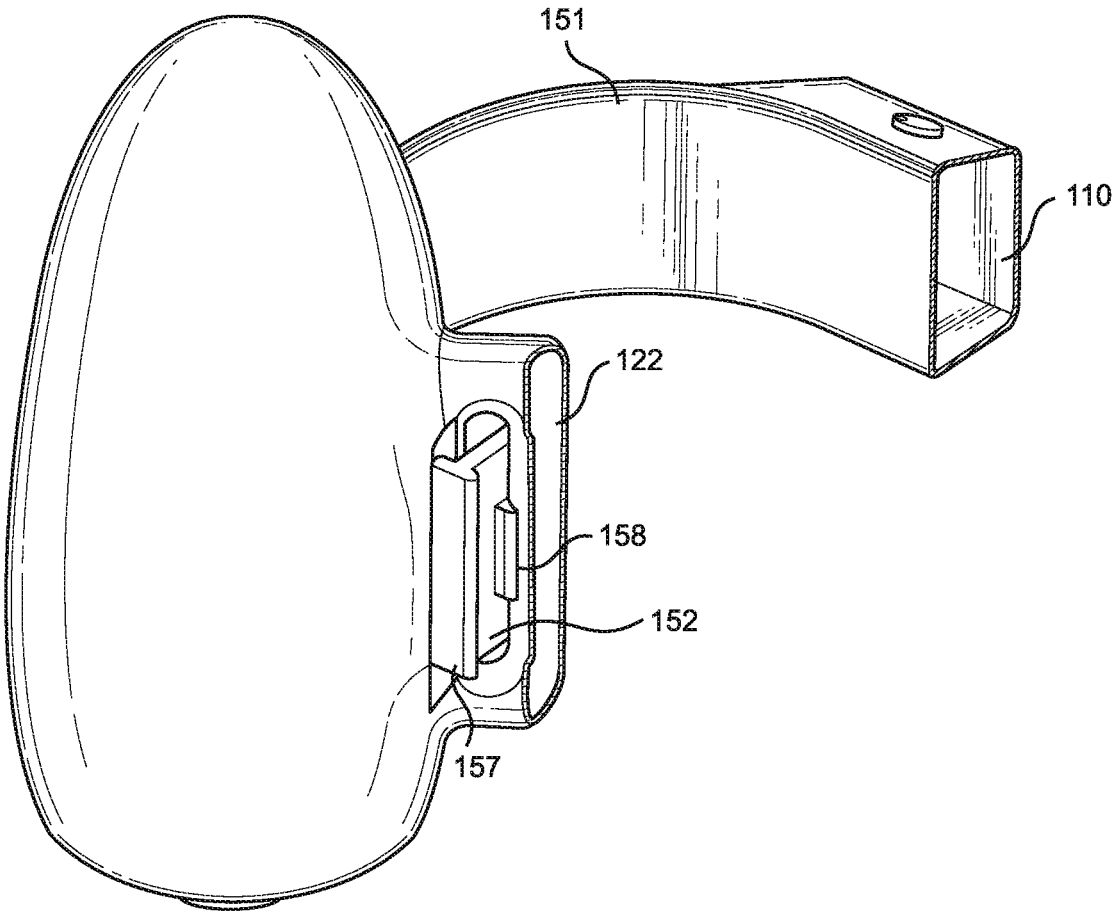
FIG. 5 is a cross sectional view of an alternative embodiment of the present disclosure.

In yet another embodiment, the tabs 152 further terminate in a stop portion 157 such that the one or more buoyant elements 120 are securable to the belt 150. Sometimes, the tabs further comprise a notch 158 such that said one or more buoyant elements 120 are securable to the belt 150 as shown in FIG. 5.

Figure 6:
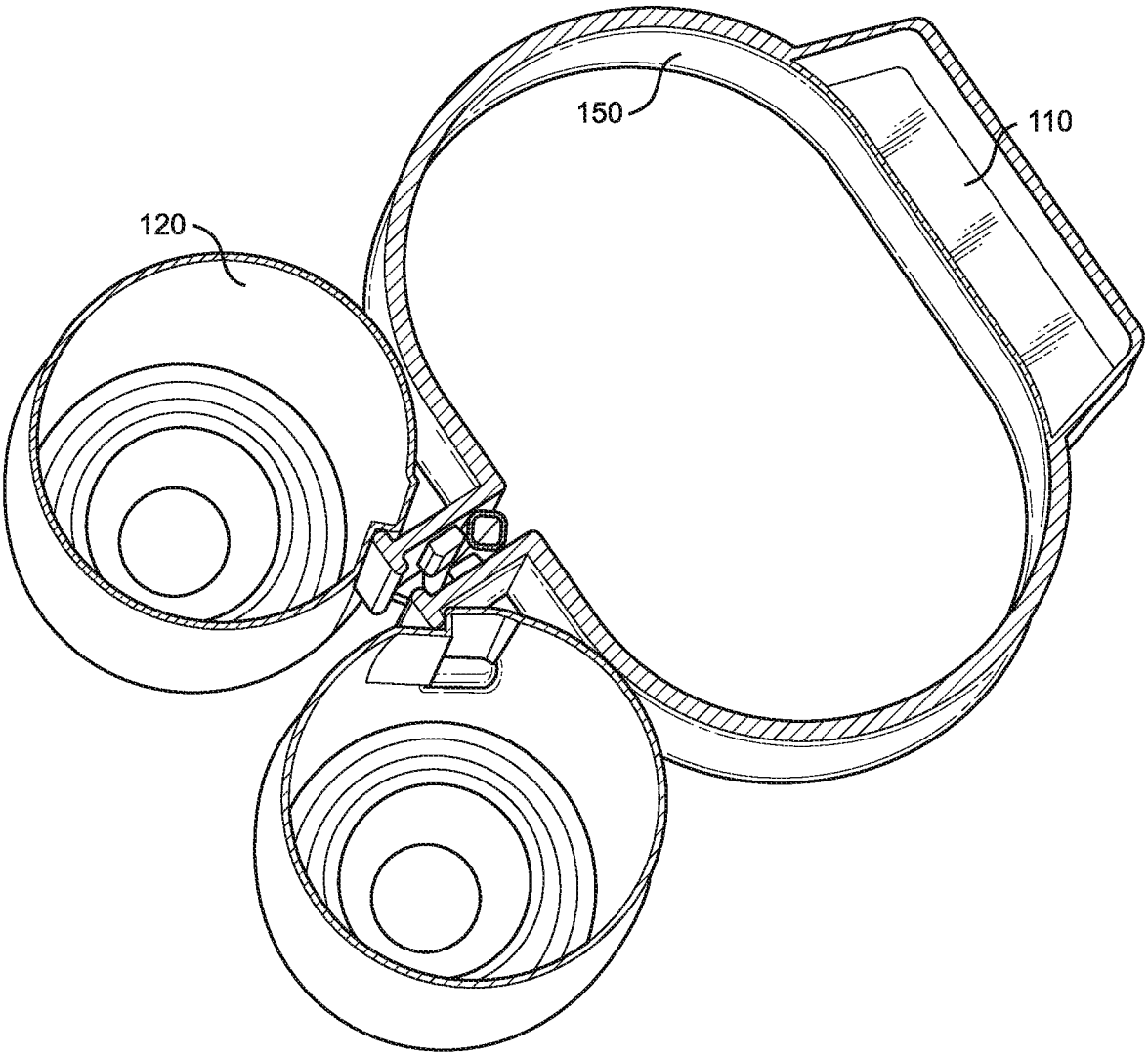
FIG. 6 is another cross-sectional view of one embodiment of the present disclosure.

In some embodiments, the tabs 152 further comprise a clip, a hook and loop, a latch and lock, a releasable buckle, and/or a clasp such that the one or more buoyant elements 120 are couplable to the belt 150. While in other embodiments, the front end of the belt comprises a hollowed-out protrusion 110 as shown in FIG. 6 adapted to keep the user in a swimming position and with a head of the user away from a body of water.

In one embodiment as shown in FIGS. 7 through 10, the one or more buoyant elements 120 are substantially cylindrical and further include a handle 122 couplable to the tabs 152. In other embodiments, the one or more buoyant elements are hydrodynamically shaped and placeable about a back of the user such that the swim aid device allows for swimming training and allows a user to remain in a swimming position.

Figure 7:
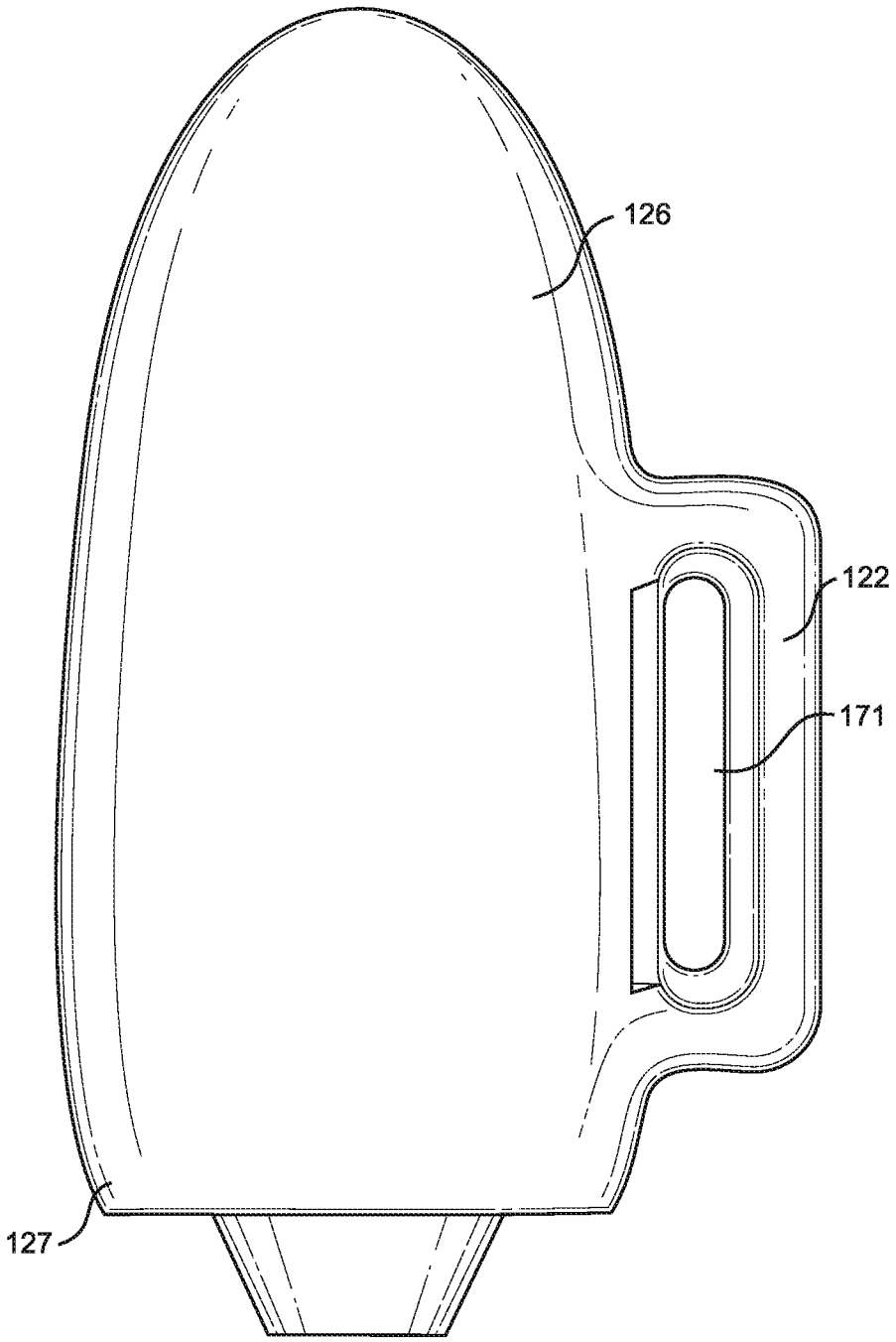
FIG. 7 is a side view of one embodiment of the buoyancy element of the present disclosure.
Figure 9:
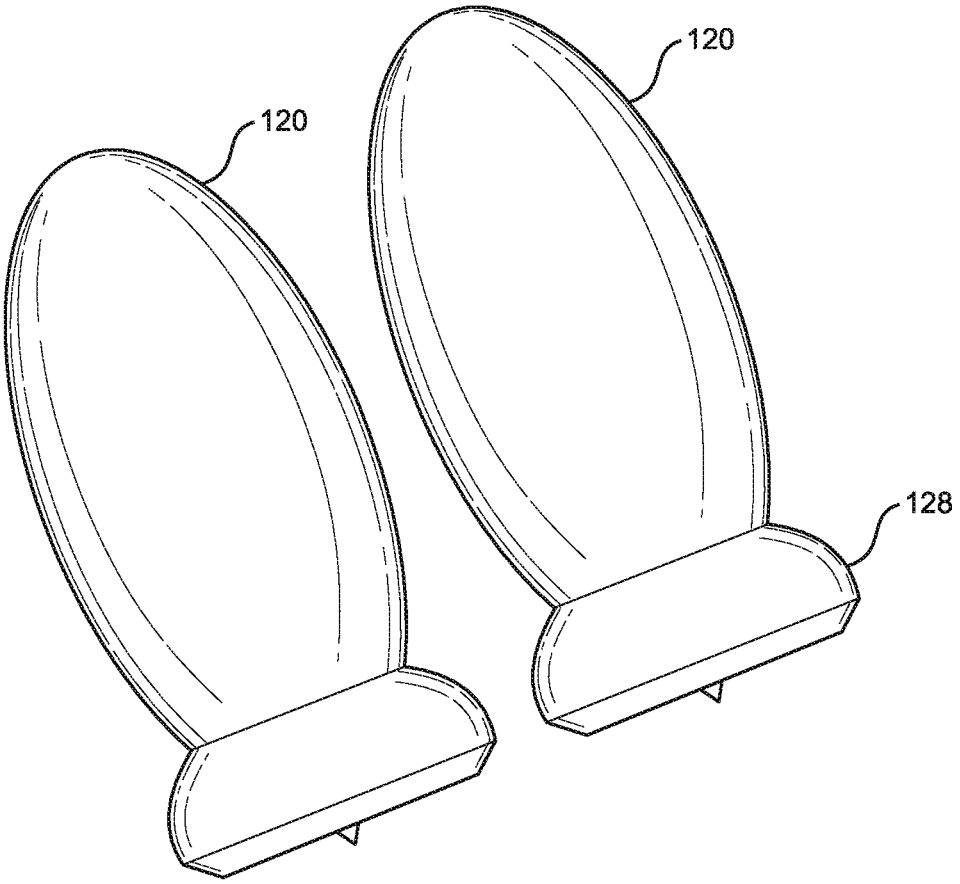
FIG. 9 is a perspective view of one embodiment of the buoyancy elements of the present disclosure.
Figure 10:
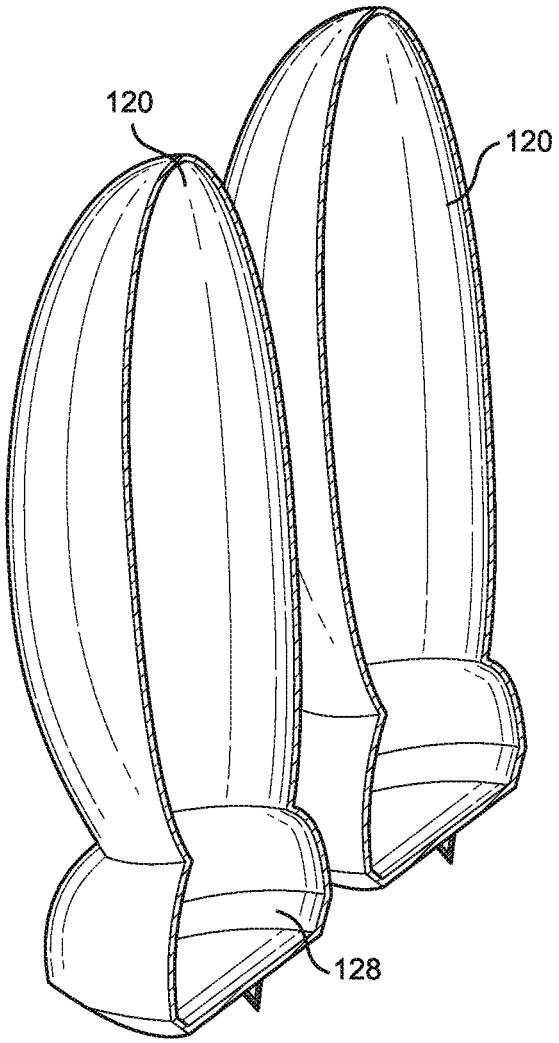
FIG. 10 is a cross sectional view of one embodiment of the buoyancy elements of the present disclosure.
Figure 11:
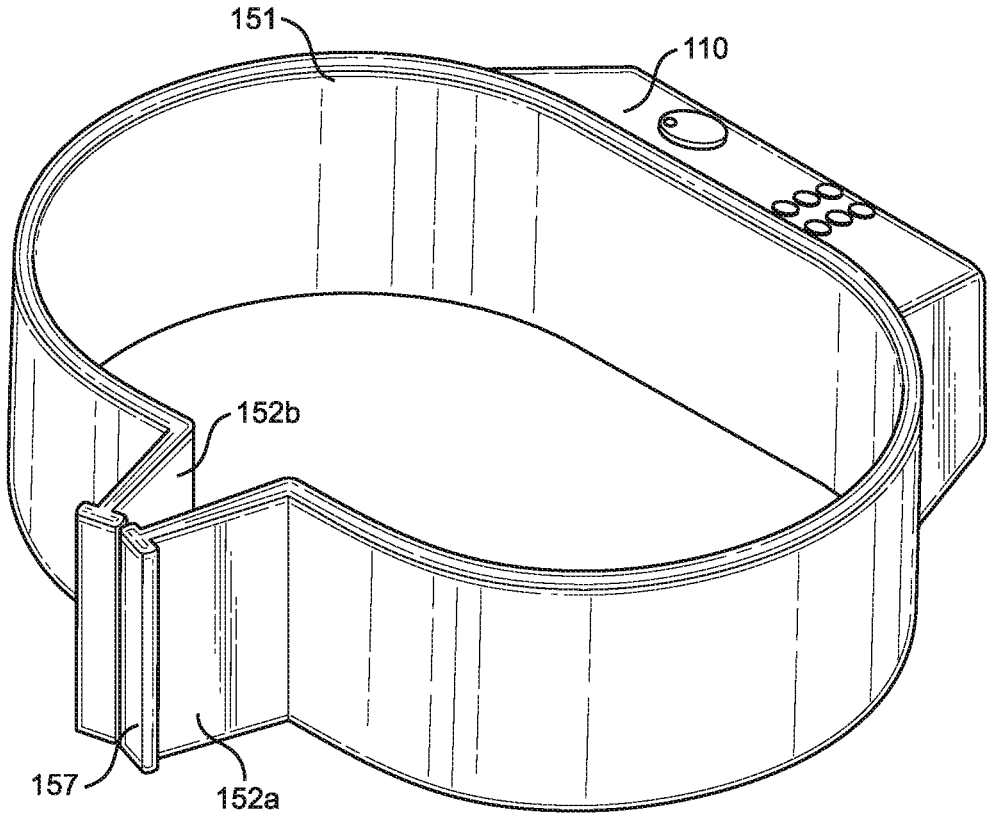
FIG. 11 is a perspective view of one embodiment of the belt of the present disclosure.
Figure 12:
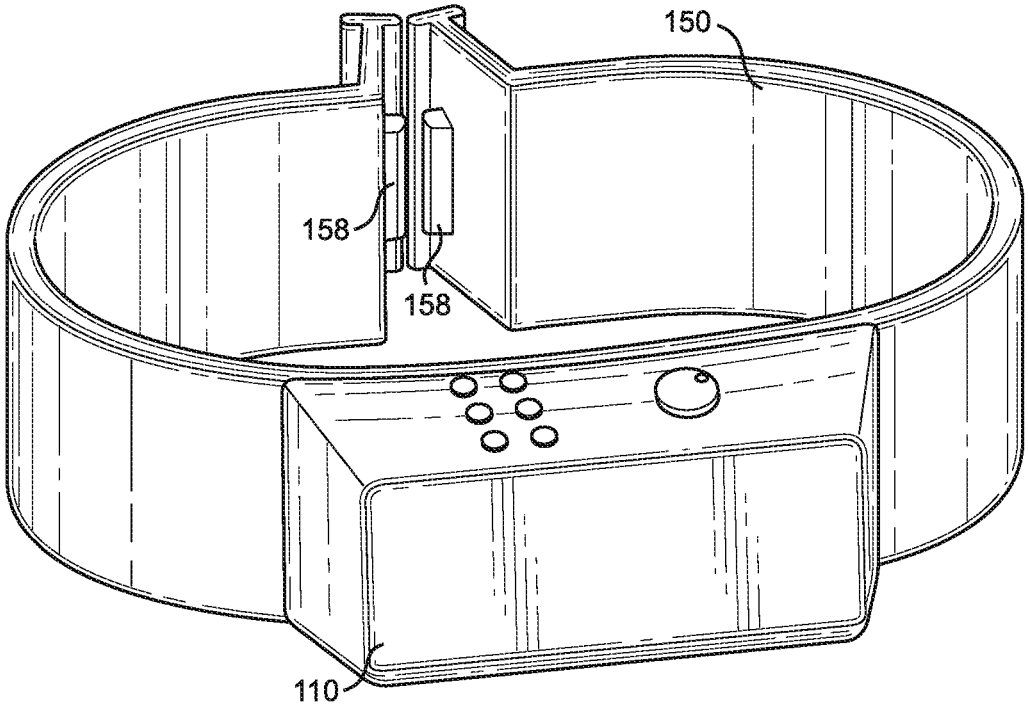
FIG. 12 is a front view of one embodiment of the belt of the present disclosure.
Figure 13:
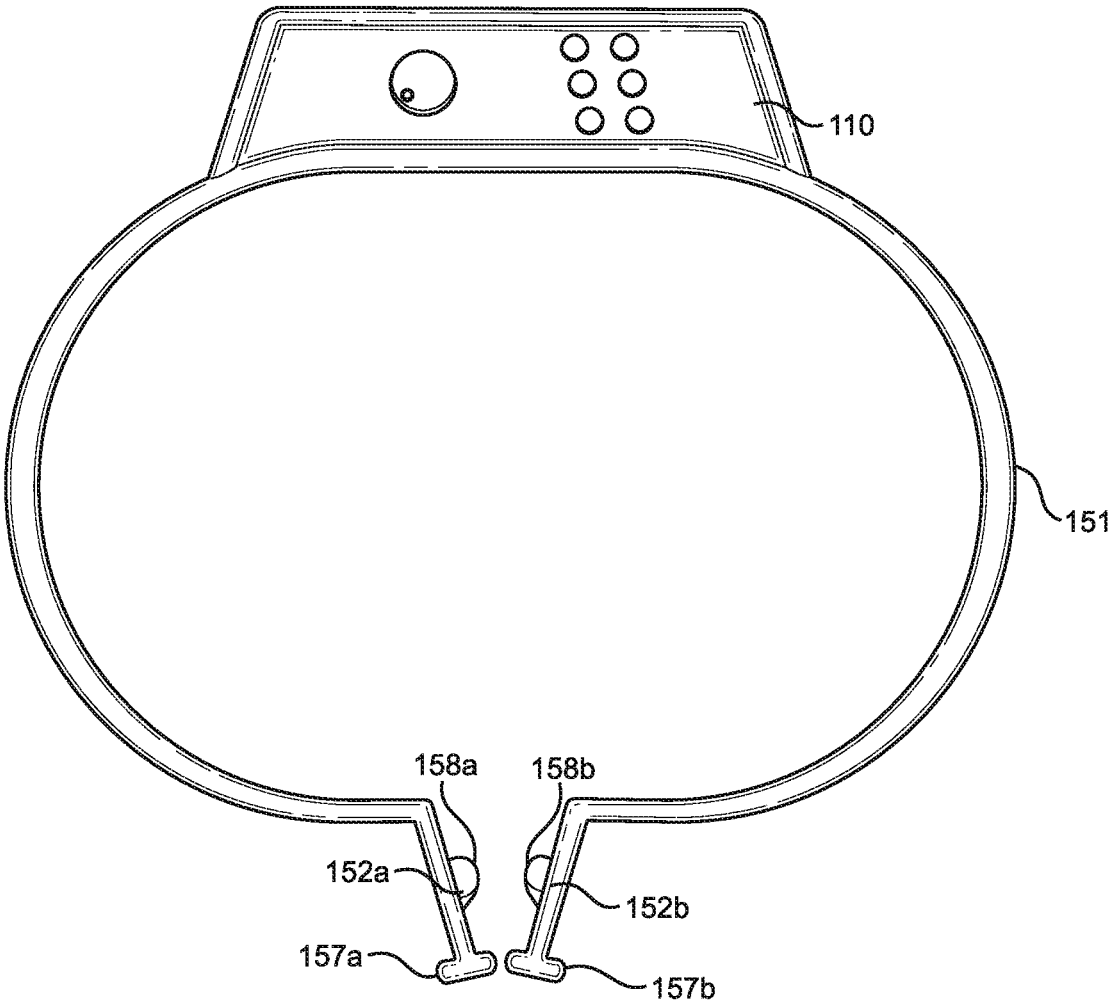
FIG. 13 is a top view of one embodiment of the belt of the present disclosure.

In some embodiments, the one or more buoyant elements 120 further comprise an indentation 125 allowing a clearance of the tabs and securing said one or more buoyant elements 120 to the belt 150. In other embodiments, the one or more buoyant elements further comprise a top end 126 and a bottom end 127 opposite the top end and a main body and where the top end is dome shaped and efficiently hydrodynamic as shown in FIG. 7. In yet another embodiment, as shown in FIG. 9 the bottom end 127 of the buoyant elements extend outwardly from a radius 128 of the main body further allowing a user to remain in a swimming position. This ensure that while the swim aid device is worn by a user, the buoyant elements 120 in conjunction with the front protrusion of the belt 110 ensures that a user remains afloat in a swimming position with a user's head away from the body of water. And in another embodiment, the bottom end 127 of the buoyant element is substantially flat.

In another embodiment, the swim aid device 100 of the present disclosure has a belt 150 having a front end 153 and a back end 154 opposite the front end where the back end comprises a closure mechanism and where the front end comprises a floating element 120. The swim aid device also includes one or more buoyant elements 120 couplable to the back end of the belt where the swim aid device allows a user to remain in a swimming position and with a head of the user away from a body of water. In another embodiment, the one or more buoyant elements also include a channel 171 operatively couplable to the belt and can be inserted into a belt and secured about the back end of the belt.

The present disclosure can also be embodied in a method of swimming training using a swim aid device comprising a belt having a hoop portion including a first tab and a second tab, a front end and an opposite back end where the back end comprises an opening and where the belt is biased in a first closed position and operatively openable to a second open position, one or more buoyant elements couplable to said back end of the belt and securable in place with said tabs wherein a buoyancy of the one or more buoyant elements allows a user to remain afloat. The method includes the steps of i) opening the belt of the swim aid device and securing said swim aid device around a waist of the user; ii) allowing said swim aid device to regain its biased first closed position; iii) positioning the back end of the swim aid device and the one or more buoyant elements along a back of the user; iv) entering a body of water with a head upward; v) initiating a swimming position wherein a torso of the user is in the body of water and the back of the user is afloat all while the head of the user remains outside of the body of water; and vi) performing a swimming training exercise.

In other embodiment the device also has a front buoyant element along the front end of the belt and the method also includes the step of placing the front buoyant element along a front of the waist of the user prior to the step of entering the body of water. In other embodiments of the method, the method includes the steps of tightening the swim aid device around the waist of the user.

The figures show the swim aid device 100 comprising a belt 150 having a first end and a second end terminating in tabs 152 and two sealed and substantially hollow buoyant elements 120 securely coupled to the belt 150 such that when a user is immersed, the buoyant elements 120 remain coupled to said belt.

In some embodiments such as the ones showing in FIGS. 11 through 15, the belt 150 is a flexibly rigid belt made with hardened materials such that the floats can attach to the belt without the need of additional external clips or components to secure the floats to the belt. The flexibly rigid belt allows a user to pull the belt open, place it around a person's waist and the rigidity of the belt allows the belt to take back its shape after being worn and remains around a person's body and waist.

In other embodiments not depicted here, the belt is made of a soft and flexible material and the buoyant elements are inserted within the belt 150.

Figure 14:
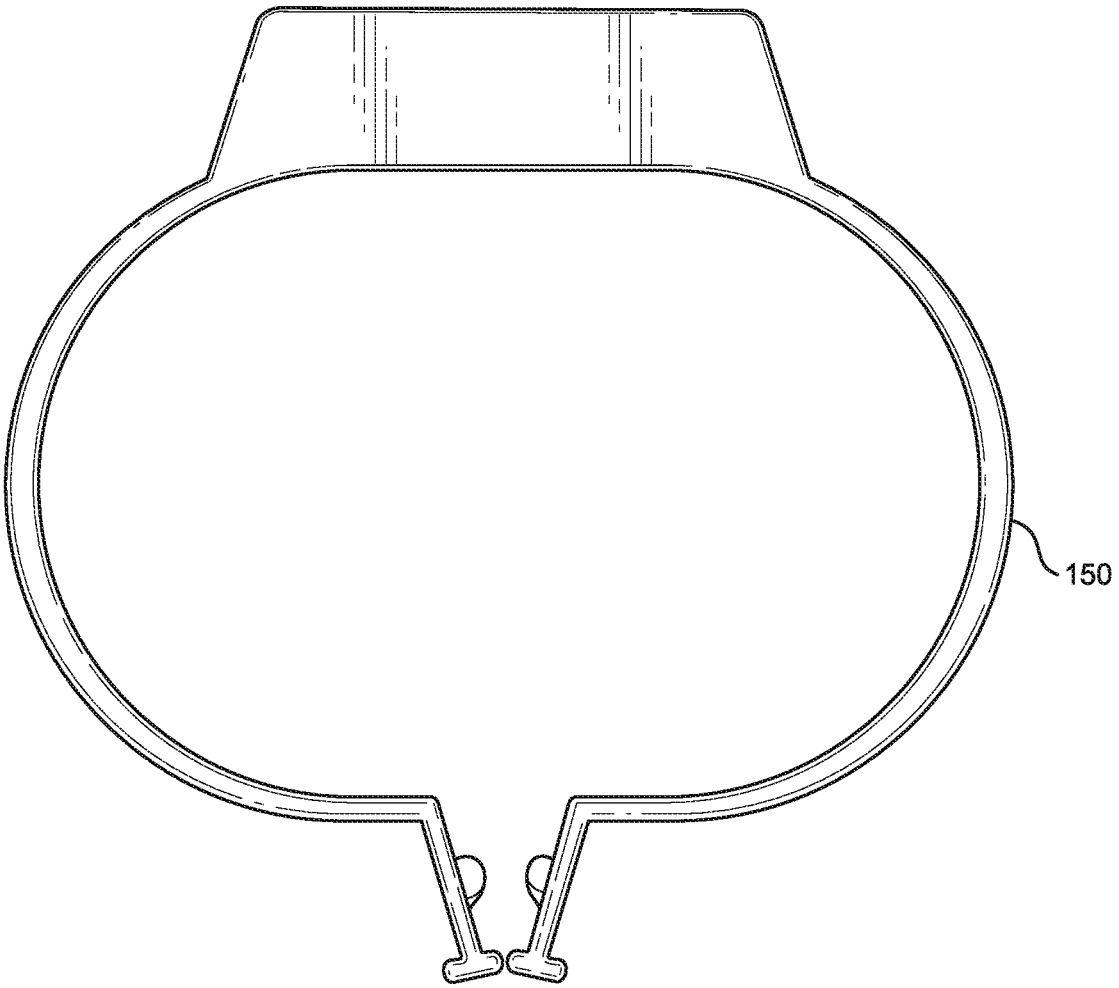
FIG. 14 is a top view of one embodiment of the belt of the present disclosure.
Figure 15:
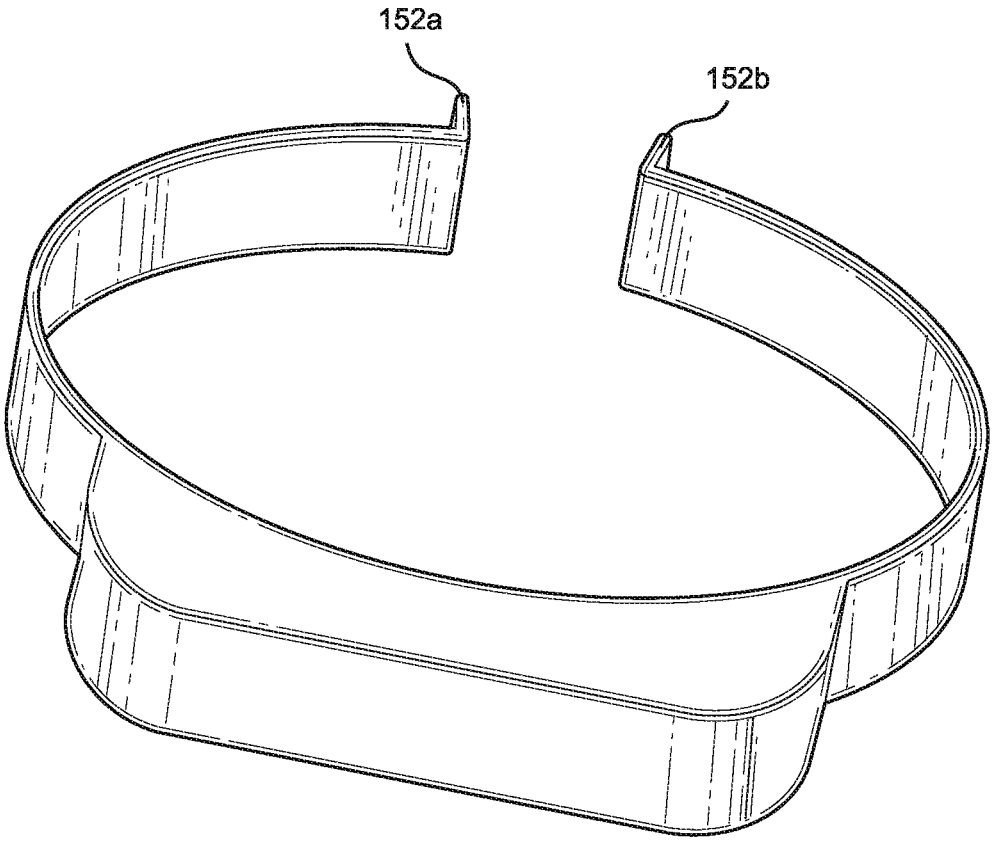
FIG. 15 is a front perspective view of another embodiment of the belt of the present disclosure.

In one embodiment such as the one shown in FIG. 14, the rigid belt 150 terminates in two stop portions 157 to keep the buoyant elements 120 within the belt 150. In other embodiments such as the one shown in FIG. 13, the belt terminates in two stop portions 157*a* and 157*b*. In one particular embodiment, the belt also includes clip tabs providing additional means of securing the buoyant elements 120 to the belt 150. Here, the clips hold the floats in place and on the belt and ensure that the floats do not slip out when being used.

In some embodiments, the device terminates in clips which are adapted to be coupled to the floats and ensure that the floats remain securely attached to the belt even if a user jumps into the water or moves about a lot. The belt can be rigid or soft and can include a protruding front end for added buoyancy and for ease of use. In some embodiments, the floats include clip attachments adapted to engage with the belt clips and further ensure that the floats remain securely attached to the device at all times.

In some embodiments, the belt is not buoyant while in other embodiments, the belt is lightly or very buoyant. In embodiments where the belt is buoyant, the floats are adapted to adjust for the buoyancy of the belt such that the entire device allows the user to swim freely about a body of water while maintaining an optimal angled position when in the water.

In some embodiments, the belt 150 includes a belt front end 53. When the belt includes a front end 153 and a front protrusion 110 such as the ones depicted in FIG. 13, the entire device's buoyancy remains optimal. Other embodiments do not include a device front end. In all embodiments, the device's edges are soft and comfortable for prolonged wearing in all environments.

Most embodiments include a pair of buoyant elements 120 attached to the back of the belt 150. The floats include a float clip attachment which allows the floats to be securely attached to the belt such that the floats do not separate from the belt under extreme use, jumping in the water with full force or other use cases for children's use in water. Thanks to float clip attachments, the floats are securely and stably attached to the belt.

Figure 8:
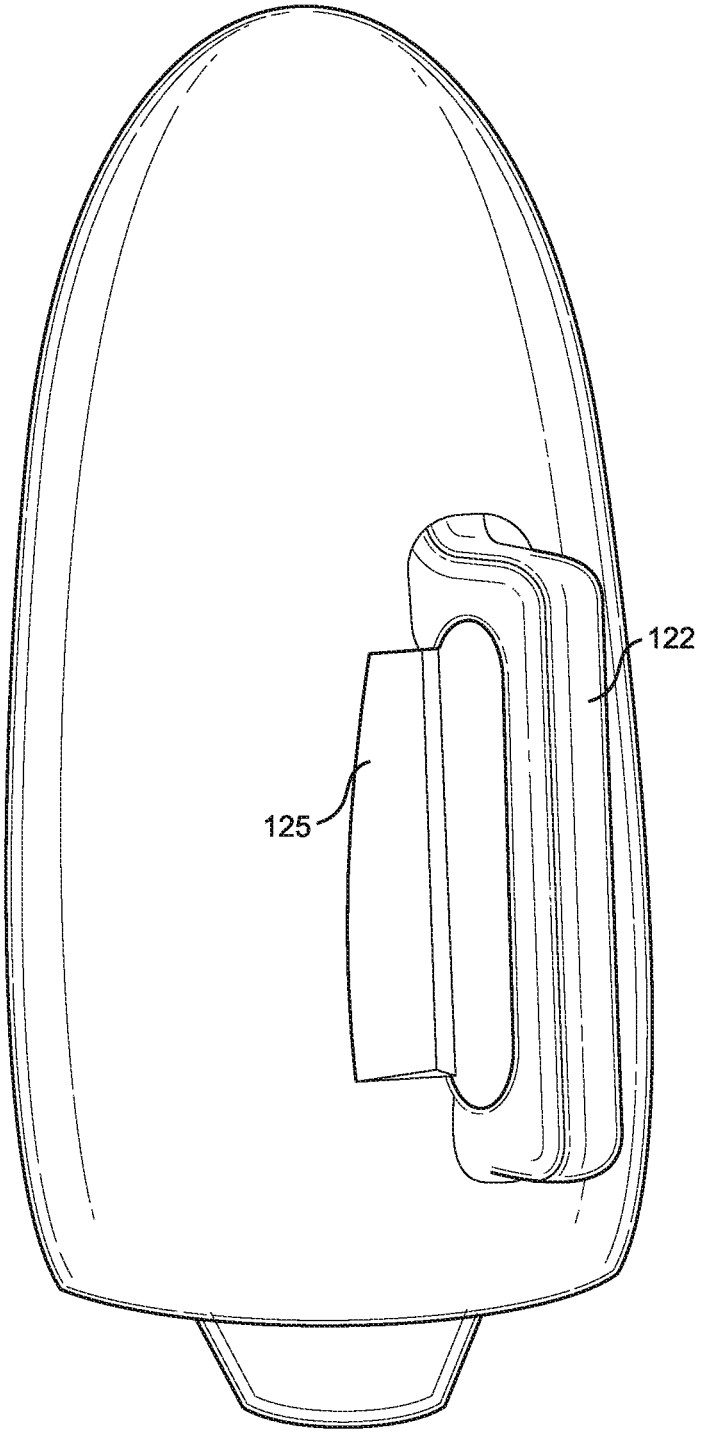
FIG. 8 is a rear view of one embodiment of the buoyancy element of the present disclosure.

In some embodiments, the one or more buoyant elements include a protruding element 128 at the bottom end of the float to help a swimmer remain at a desired angle when in the water, and to ensure that a user's head does not get submerged when swimming. These protruding elements also help keep a user afloat with the forward portion of their body above water. FIGS. 8 and 9 show two various embodiments of the buoyant elements. While in some embodiments, the protruding element 128 extend radially outward at the end of the float as shown in FIG. 8, in other embodiments, the protruding element extends at one given radius and protrudes out in one size while in other embodiments, the protrusion grows radially outward the further away it is from the main body of the float.

In some embodiments, the floats are inserted into a tab portion of the belt and remain securely attached to the belt. In other embodiments, the floats are clipped onto the belt, snapped onto the belt, hooked onto, clicked onto the belt, secured thanks to external attachment means and/or inserted into the belt and the belt tab expands outwardly once the floats are in to ensure that the floats remain securely attached to the belt.

In other embodiments, the floats include indentations complementary with protrusions on the belt for coupling. Here the floats remain securely attached to the belt. In other embodiments, the floats expand tubularly outwardly. In these specific embodiments, the volume distribution of air remains optimal to ensure that a user is afloat with the forward portion of the body raised above water for proper breathing.

In some embodiments, the device is tapered, and the edges are softened for comfort and can softly be removed.

In accordance with one form of this disclosure, there is provided a method for using a swim aid device where a user wears said device around a person's body. The belt comprises opening between two floats and a user can stretch the belt to wear it around the waist. The rigid belt allows for the device to be worn around the body without a need for a closure mechanism. The floats are worn around the back of a user.

As mentioned above, other embodiments and configurations may be devised without departing from the spirit of the invention and the scope of the appended claims.

What is claimed is:

1. A swim aid device, comprising:

a) a belt having:

i) a rigid hoop portion including a first tab and a second tab;

ii) a front end and a back end opposite said front end wherein the back end includes an opening and wherein the belt is biased in a first closed position and operatively openable to a second open position; and b) one or more buoyant elements couplable to said back end of the belt and securable in place with said tabs wherein a buoyancy of the one or more buoyant elements allows a user to remain afloat and wherein the one or more buoyant elements are substantially cylindrical and further include a handle couplable to said tabs, wherein the one or more buoyant elements are hydrodynamically shaped and placeable about a back of the user such that said device allows for swimming training and allows a user to remain in a swimming position, and wherein the one or more buoyant elements further comprise an indentation thereby allowing a clearance of the tabs and securing said one or more buoyant elements to the belt.

2. The swim aid device of claim 1, wherein said belt is rigid and deformable to said second open position adapted to extend about a waist of the user.

3. The swim aid device of claim 2, wherein when said belt is deformed from the first closed position to said second open position adapted to extend around the waist of the user, said belt goes back to the biased first closed position and is adapted to remains secure around the waist of the user.

4. The swim aid device of claim 1, wherein said belt is generally adapted to conform to a waist of the user, such that when used, the swim aid device is adapted to allow the user's arms, torso and legs to be uncovered and unrestricted and such that the swim aid device provides flotation assistance and avoids interference with a swimming activity.

5. The swim aid device of claim 1, wherein said hoop portion terminates in said first tab opposing said second tab and wherein said first tab and said second tab extend at an angle and away from said hoop portion such that the one or more buoyant elements are securable to the belt.

6. The swim aid device of claim 5, wherein said tabs further terminate in a stop portion such that the one or more buoyant elements are securable to the belt.

7. The swim aid device of claim 5, wherein said tabs further comprise a notch such that said one or more buoyant elements are securable to the belt.

8. The swim aid device of claim 1, wherein said tabs further comprise at least one of a clip, a hook and loop, a latch and lock, a releasable buckle, and a clasp such that the one or more buoyant elements are couplable to said belt.

9. The swim aid device of claim 1, wherein said front end of the belt comprises a hollowed-out protrusion adapted to keep the user in a swimming position and with a head of the user away from a body of water.

10. The swim aid device of claim 1 wherein said one or more buoyant elements are substantially cylindrical and further include a handle couplable to said tabs.

11. The swim aid device of claim 10 wherein said one or more buoyant elements are hydrodynamically shaped and placeable about a back of the user such that said device allows for swimming training and allows a user to remain in a swimming position.

12. A swim aid device, comprising:

a) a belt having:

i) a rigid hoop portion including a first tab and a second tab;

ii) a front end and a back end opposite said front end wherein the back end includes an opening and wherein the belt is biased in a first closed position and operatively openable to a second open position; and b) one or more buoyant elements couplable to said back end of the belt and securable in place with said tabs wherein a buoyancy of the one or more buoyant elements allows a user to remain afloat and wherein the one or more buoyant elements are substantially cylindrical and further include a handle couplable to said tabs, wherein the one or more buoyant elements are hydrodynamically shaped and placeable about a back of the user such that said device allows for swimming training and allows a user to remain in a swimming position, and wherein the one or more buoyant elements further comprise an indentation thereby allowing a clearance of the tabs and securing said one or more buoyant elements to the belt.

13. The swim aid device of claim 12 wherein said one or more buoyant elements further comprise a top end and a bottom end opposite said top end and a main body and wherein said top end is dome shaped and hydrodynamic.

14. The swim aid device of claim 13 wherein the bottom end of said one or more buoyant elements extend outwardly from a radius of the main body further allowing a user to remain in a swimming position.

15. The swim aid device of claim 13 wherein the bottom end is substantially flat.

16. A method of using a swim aid device comprising a belt having a rigid hoop portion including a first tab and a second tab, a front end and an opposite back end wherein the back end comprises an opening and wherein the belt is biased in a first closed position and operatively openable to a second open position, one or more buoyant elements couplable to said back end of the belt and securable in place with said tabs wherein a buoyancy of the one or more buoyant elements allows an object to remain afloat and wherein the one or more buoyant elements are substantially cylindrical and further include a handle couplable to said tabs, wherein the one or more buoyant elements are hydrodynamically shaped and placeable about a back of the object such that said device allows for swimming training and allows the object to remain in a swimming position, and wherein the one or more buoyant elements further comprise an indentation thereby allowing a clearance of the tabs and securing said one or more buoyant elements to the belt; the method comprising the steps of:

i) opening the belt of the swim aid device and securing said swim aid device around the object;

ii) allowing said swim aid device to regain its biased first closed position;

iii) positioning the back end of the swim aid device and the one or more buoyant elements along one side of the object; and iv) allowing the object to entering a body of water with the swim aid device and remain afloat.

17. The method of swimming training of claim 16 wherein said swim aid device further comprises a front buoyant element along the front end of the belt and further including the step of placing said front buoyant element along a front of the object prior to the step of entering the body of water.

18. The method of swimming training of claim 16 further comprising the step of tightening the swim aid device around the object.

* * * * *